US007131296B2

(12) United States Patent
Dua et al.

(10) Patent No.: US 7,131,296 B2
(45) **Date of Patent: *Nov. 7, 2006**

(54) FOOTWEAR WITH KNIT UPPER AND METHOD OF MANUFACTURING THE FOOTWEAR

(75) Inventors: Bhupesh Dua, Portland, OR (US); Edward Nathaniel Thomas, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/334,731

(22) Filed: Jan. 17, 2006

(65) Prior Publication Data

US 2006/0130359 A1 Jun. 22, 2006

Related U.S. Application Data

(60) Continuation of application No. 11/024,480, filed on Dec. 30, 2004, now Pat. No. 6,986,269, which is a division of application No. 10/323,608, filed on Dec. 18, 2002, now Pat. No. 6,931,762.

(51) Int. Cl.
*D04B 9/46* (2006.01)

(52) U.S. Cl. ..... 66/178 R; 66/202

(58) Field of Classification Search ..... 66/170–188; 36/9 R, 45
See application file for complete search history.

(56) References Cited

U.S. PATENT DOCUMENTS 1,597,934 A * 8/1926 Stimpson ..... 36/3 A (Continued)

OTHER PUBLICATIONS

Internet publication entitled "Acorn Footwear—Slipper Sock," from Northland Marine, which shows products that were on sale in this country at least one year prior to Dec. 18, 2002 (1 page).

(Continued)

*Primary Examiner*—Danny Worrell
(74) *Attorney, Agent, or Firm*—Banner & Witcoff, Ltd.

(57) ABSTRACT

An article of footwear with a knit upper and a method of manufacturing the footwear are disclosed. The upper is formed through a knitting process to include a plurality of sections formed of different yarns and knits to provide the sections with different physical properties. In portions of the upper where sections formed of different yarns are in adjacent wales, a tuck stitch is utilized to join the sections. The method utilizes a circular knitting machine having multiple feeds that work together to knit the upper into a unitary, seamless structure. The multiple feeds, each of which provide multiple types of yarns, produce the sections to have varying physical properties.

25 Claims, 3 Drawing Sheets

U.S. PATENT DOCUMENTS

| | | | | | |
|---|---|---|---|---|---|
| 2,092,616 | A | * | 9/1937 | Ruckel | 66/182 |
| 2,147,197 | A | * | 2/1939 | Gidden | 36/9 R |
| 2,675,631 | A | * | 4/1954 | Doughty | 36/9 R |
| 4,211,806 | A | * | 7/1980 | Civardi et al. | 428/91 |
| 4,216,662 | A | * | 8/1980 | Harris et al. | 66/186 |
| 4,255,949 | A | * | 3/1981 | Thorneburg | 66/185 |
| 4,373,361 | A | * | 2/1983 | Thorneburg | 66/178 R |
| 4,447,967 | A | * | 5/1984 | Zaino | 36/45 |
| 4,607,439 | A | * | 8/1986 | Sogabe et al. | 36/45 |
| 4,785,558 | A | * | 11/1988 | Shiomura | 36/114 |
| 4,813,158 | A | * | 3/1989 | Brown | 36/114 |
| 5,724,836 | A | * | 3/1998 | Green | 66/185 |
| 6,931,762 | B1 | * | 8/2005 | Dua | 36/9 R |
| 6,986,269 | B1 | * | 1/2006 | Dua | 66/177 |

OTHER PUBLICATIONS

Internet publication entitled "Welcome to Arcopedico Shoe," from Arcopedico Shoes, which shows products that were on sale in this country at least one year prior to Dec. 18, 2002 (4 pages).

Leaflet entitled "X machine," from Sangiacomo S.p.A., which was on sale in this country at least one year prior to Dec. 18, 2002 (1 page).

Advertising material entitled "Still Crazy After All These Years," which shows a product entitled "Sock Racer," and was sold in this country in 1986 by NIKE, Inc. (3 pages).

* cited by examiner

FOOTWEAR WITH KNIT UPPER AND METHOD OF MANUFACTURING THE FOOTWEAR

CROSS-REFERENCE TO RELATED APPLICATION

This U.S. patent application is a continuation application of and claims priority to U.S. Pat. No. 6,986,269, which was filed in the U.S. Patent and Trademark Office on Dec. 30, 2004, assigned Ser. No. 11/024,480, and entitled Footwear With Knit Upper And Method Of Manufacturing The Footwear. U.S. Pat. No. 6,986,269 is, in turn, a divisional application of and claimed priority to U.S. Pat. No. 6,931,762, which was filed in the U.S. Patent and Trademark Office on Dec. 18, 2002, assigned U.S. patent application Ser. No. 10/323,608, and entitled Footwear With Knit Upper And Method Of Manufacturing The Footwear. Both U.S. Patents are incorporated herein in their entireties.

BACKGROUND OF THE INVENTION

1. Field of the Invention

The present invention relates to footwear and the manufacture of footwear. The invention concerns, more particularly, a footwear upper formed through a textile manufacturing process to have areas with different physical properties.

2. Description of Background Art

Conventional articles of athletic footwear generally include two primary elements, an upper and a sole structure. The upper is attached to the sole structure and forms a void on the interior of the footwear for securely and comfortably receiving a foot. The sole structure attenuates ground reaction forces and absorbs energy as the footwear contacts the ground, and often incorporates multiple layers that are conventionally referred to as a midsole and an outsole. The midsole forms the middle layer of the sole and serves a variety of purposes that include controlling potentially harmful foot motions, such as over pronation; shielding the foot from excessive ground reaction forces; and beneficially utilizing such ground reaction forces for more efficient toe-off. The outsole forms the ground-contacting element of footwear and is usually fashioned from a durable, wear resistant material that includes texturing to improve traction. The sole structure may also include an insole, which is a thin, cushioning member located within the upper and adjacent to a sole of the foot to enhance footwear comfort.

The upper of most conventional articles of footwear is generally formed from multiple material elements that are stitched and adhesively bonded together to form a comfortable structure for receiving the foot. Conventional athletic footwear may include, for example, an exterior formed of leather and polymer textile materials that are resistant to abrasion and provide the footwear with a particular aesthetic. Foam materials may be located on the interior of the upper to enhance the comfort of the upper, and moisture-wicking textiles may be positioned adjacent the foot to limit the perspiration within the upper.

In a departure from the conventional upper described above, NIKE, Inc. of Beaverton, Oreg., United States manufactures athletic footwear with a knit upper under the PRESTO trademark. The knit upper includes a plurality of material elements that are formed through a knitting process. In manufacturing the upper, the material elements are cut from a larger element and sewn together along their respective edges to form a generally hollow structure for receiving a foot. The upper, therefore, includes a plurality of separately-formed, knit sections stitched together to form seams between the various sections.

Based upon the discussion above, the uppers for athletic footwear are generally constructed of numerous materials or elements. In manufacturing the uppers, considerable time and labor is expended in cutting the various elements to have a proper shape and size, and stitching or adhesively bonding the elements to each other. Consequently, these footwear manufacturing techniques are not only time and labor intensive, but also result in an undesirable amount of waste materials resulting from the trimming of the materials to make the elements.

A unitary upper formed through a knitting process is disclosed in U.S. Pat. No. 2,147,197 to Glidden. The upper is knitted to have a sock-like structure in which areas subjected to greater wear and in which a lower degree of elasticity is desired are more densely fabricated to provide heavier weight and less extensibility than in other portions. This may be accomplished, for example, by changing the type of stitch. Other areas, such as the ankle portion, may be formed to have a ribbed construction to provide softness and elasticity.

SUMMARY OF THE INVENTION

The present invention is an article of footwear having a sole structure and an upper. The sole structure provides a ground-contacting surface, and the upper is structured to receive a foot of a wearer. The upper is attached to the sole structure and has a first section and a second section formed of knit materials. The first section is formed of a first yarn with a first physical property, and the second section is formed of a second yarn with a second physical property. The first physical property is different than the second physical property. The first and second sections are connected by tuck stitches that join the first section and the second section in a seamless manner.

Other methods of joining the first section and the second section may form tails, or ends of yarns, that are exposed and may cause the area between the first and second sections to unravel. By utilizing a tuck stitch, however, tails are not formed and the first and second sections are joined seamlessly.

A method of manufacturing an upper that is similar to the upper described above may be performed through three general steps. First, a first section of the upper is knitted from a first yarn having a first physical property. Second, a second section of the upper is knitted from a second yarn having a second physical property, with the first physical property being different than the second physical property. Furthermore, tuck stitches are knitted between the first section and the second section to join the first section with the second section. In order to perform the steps described above, a narrow-tube circular knitting machine may be utilized.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose an article of footwear 10 and a method of manufacturing footwear 10 in accordance with the present invention. Footwear 10 includes an upper that is formed as a unitary, knit structure with various sections having different physical properties. The various sections are joined in a generally seamless manner and may exhibit different degrees of strength, abrasion-resistance, stretch, support, stiffness, recovery, fit, and form, for example. In joining the various sections, tuck stitches are utilized to seamlessly-connect sections between wales.

Figure 1:
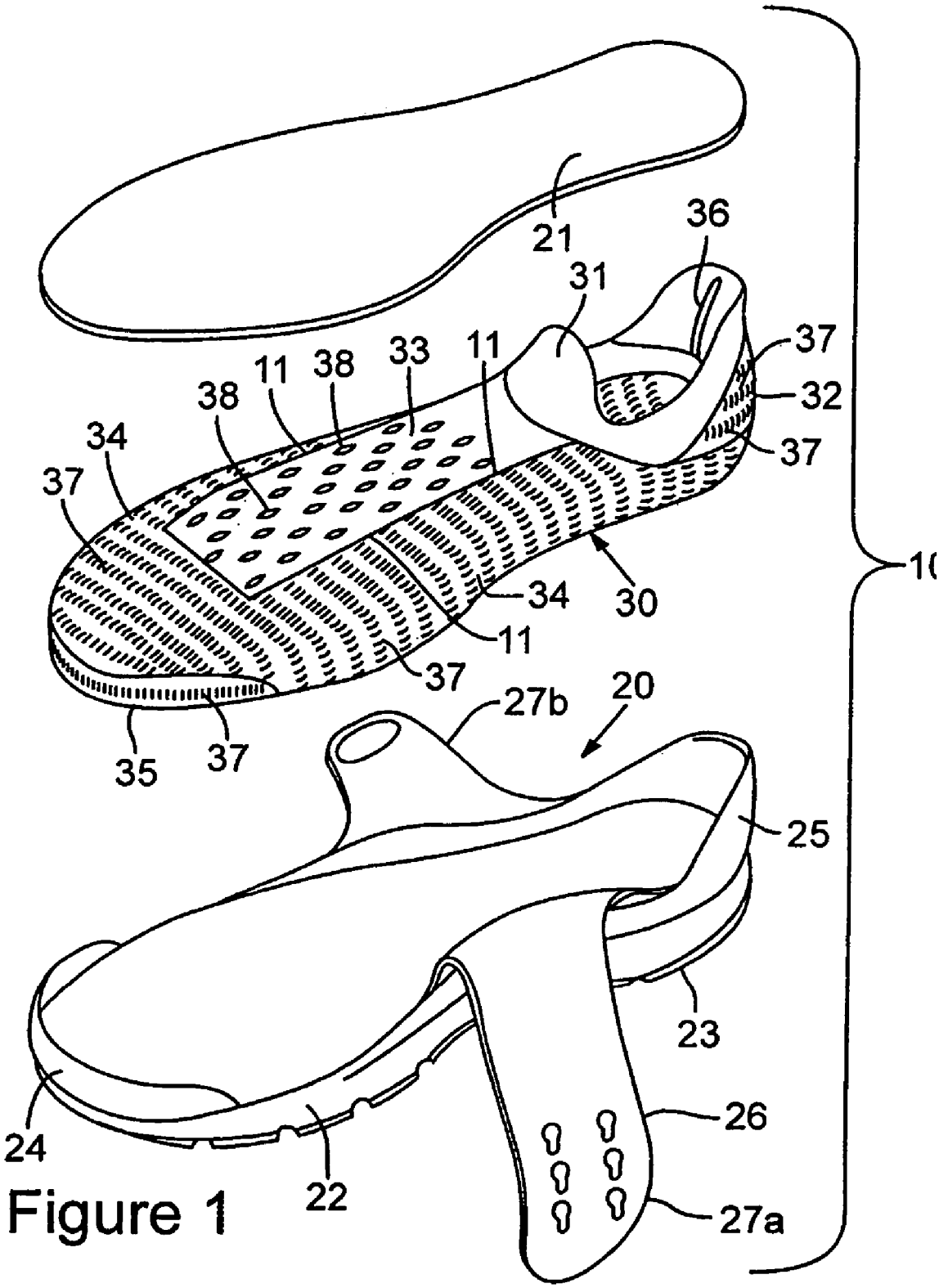
FIG. 1 is an exploded perspective view of an article of footwear that incorporates an upper in accordance with the present invention.

An exploded view of footwear 10 is depicted in FIG. 1 and includes a sole structure 20 and an upper 30 that is attached to sole structure 20 through adhesive bonding or stitching, for example. Sole structure 20 provides a durable, ground-contacting surface and attenuates ground reaction forces and absorbs energy as footwear 10 contacts the ground. The primary elements of sole structure 20 are an insole 21, a midsole 22, and an outsole 23. Insole 21 is a thin, cushioning member located within upper 30 and adjacent to a sole of the foot to enhance footwear comfort. Midsole 22 forms the middle layer of sole structure 20 and may be structured to serve a variety of purposes that include controlling potentially harmful foot motions, such as over pronation; shielding the foot from excessive ground reaction forces; and beneficially utilizing such ground reaction forces for more efficient toe-off. Outsole 23 forms the ground-contacting element of footwear 10 and may be fashioned from a durable, wear resistant material that includes texturing to improve traction. Suitable materials for midsole 22 include ethylvinylacetate and polyurethane foam, and may include additional components such as a fluid-filled bladder. Outsole 23 may be formed from carbon black rubber compound, for example.

Sole structure 20 also includes a toe support 24, a heel support 25, and a securing system 26. Toe support 24 extends upward from a fore portion of midsole 22 and is configured to extend around fore portions of the toes to limit forward movement of the foot. Similarly, heel support 25 extends upward from a rear portion of midsole 22 and is configured to extend around the heel to limit rearward movement of the foot. A portion of heel support 25 also extends along the medial and lateral sides of the foot to limit side-to-side movement of the foot. Securing system 26 includes a pair of straps 27*a* and 27*b* that extend over the instep of the foot and operate to secure the foot within upper 30 and relative to sole structure 20.

The configuration of sole structure 20 discussed above provides an example of a suitable sole structure for the present invention. In alternate embodiments, toe support 24 and heel support 25 may extend over a greater area of the foot, for example. Securing system 26 may also include a plurality of straps that extend around the heel, over the instep, and over the toes. Accordingly, the specific configuration of sole structure 20 may vary significantly within the scope of the present invention.

Upper 30 is formed primarily from multiple yarns that are mechanically manipulated through an interlooping process to produce a unitary structure having various sections with different physical properties. Various interlooping techniques are available for mechanically manipulating yarn into upper 30. In general, however, interlooping involves the formation of a plurality of rows and columns of intermeshed loops, which are conventionally referred to as courses and wales. Knitting is generally recognized as being the most common method of interlooping.

Figure 2:
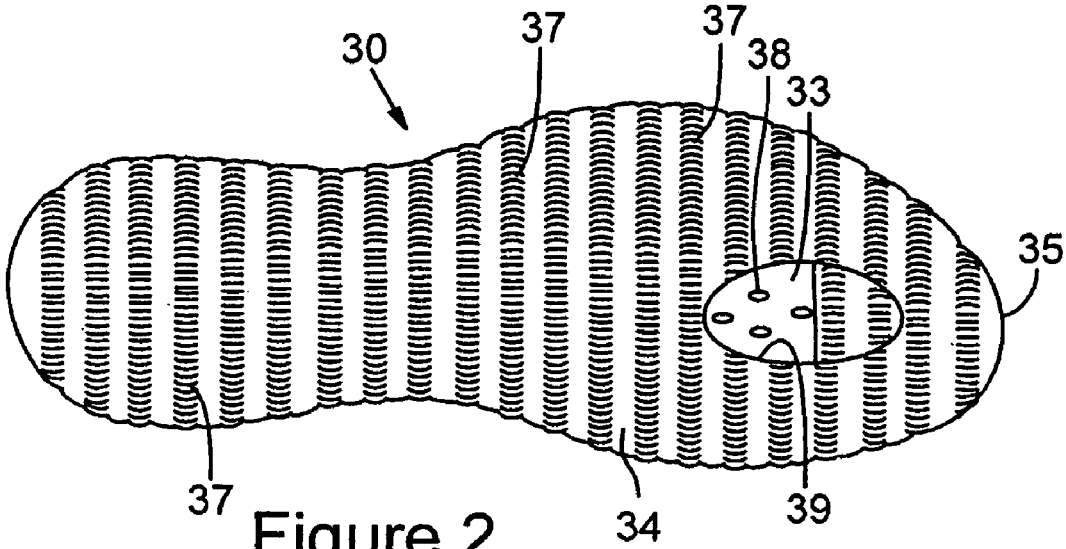
FIG. 2 is a bottom plan view of the upper.

The configuration of upper 30 is selected to generally conform to the shape of the foot. The knitting process that produces upper 30 forms a plurality of sections, each section being specifically located, knit in a specific manner, and knit with a specific type of yarn to provide each section with different physical properties. The sections in the exemplary embodiment of FIGS. 1 and 2 include an ankle section 31, a heel section 32, an instep section 33, a primary section 34, and a toe section 35. Ankle section 31 is configured to surround the ankle and form an ankle opening that provides access to the interior of upper 30. Heel section 32 is positioned adjacent to ankle section 31 and is configured to extend around a portion of the heel. Instep section 33 extends along the instep from ankle section 31. Primary section 34 extends along medial and lateral sides of the foot, over the toes, and along the sole of the foot. Finally, toe section 35 extends around the portion of upper 30 that corresponds with the ends of the toes.

The yarn and knit selected for ankle section 31 provides four-way stretch around the ankle opening. That is, ankle section 31 expands vertically and horizontally upon the application of a tensile force, thereby permitting the foot to enter upper 30. Once the foot is within upper 30, ankle section 31 contracts to recover the unstretched shape and comfortably conform to the shape of the ankle. Ankle section 31 includes an inner layer and an overlapping outer layer that are formed as a jersey knit by reversing the textile to create the two, overlapping layers. The inner layer of ankle section 31 is formed to include a slit 36. A semi-rigid element may be inserted through slit 36 to form a support positioned between the inner layer and the outer layer of ankle section 31. In order to provide the stretch and recovery properties of ankle section 31, a yarn that incorporates an elastane fiber may be utilized. Elastane fibers are available from E.I. duPont de Nemours Company under the LYCRA trademark. Such fibers may have the configuration of covered LYCRA, wherein the fiber includes a LYCRA core that is surrounded by a nylon sheath. Other fibers or filaments exhibiting elastic properties may also be utilized in ankle section 31.

Heel section 32 is formed to provide two-way stretch in the horizontal direction, but limit stretch in the vertical direction. In forming heel section 32, a ribbed texture is imparted due to inherent material shrinkage when removed from a cylinder of a narrow-tube circular knitting machine, which will be described in greater detail below. Heel section 32 stretches, therefore, along various ribs 37, which are oriented horizontally. The specific materials forming heel section 32 may include a combination of 400 denier and 800 denier nylon yarns. This combination permits the horizontal stretch, but limits stretch in the vertical direction. If, for example, four-way stretch is desired, yarn incorporating elastane fibers may be substituted. In addition, lesser stretch or no stretch may be achieved by increasing the course density and denier of the yarn in heel section 32. Depending upon the desired characteristics of heel section 32, therefore, yarns with a variety of fibers or filaments may be utilized, as discussed in detail below.

Yarn is defined as an assembly having a substantial length and relatively small cross-section that is formed of at least one filament or a plurality of fibers. Fibers have a relatively short length and require spinning or twisting processes to produce a yarn of suitable length for use in an interlooping process. Common examples of fibers are cotton and wool. Filaments, however, have an indefinite length and may merely be combined with other filaments to produce a yarn suitable for use in an interlooping process. Modern filaments include a plurality of synthetic materials such as rayon, nylon, polyester, and acrylic, with silk being the primary, naturally-occurring exception. Yarn may be formed of a single filament (conventionally referred to as a monofilament yarn) or a plurality of individual filaments. Yarn may also be formed of separate filaments formed of different materials, or the yarn may be formed of filaments that are each formed of two or more different materials. Similar concepts also apply to yarns formed from fibers. Accordingly, yarns may have a variety of configurations within the scope of the present invention that generally conform to the definition provided above.

As discussed above, nylon yarns or yarns that incorporate elastane fibers are suitable for heel section 32. The characteristics of the various yarns selected for heel section 32 depend primarily upon the materials that form the various filaments and fibers. Cotton, for example, provides a soft hand, natural aesthetics, and biodegradability. Elastane fibers, as discussed above, provide substantial stretch and recoverability. Rayon provides high luster and moisture absorption. Wool also provides high moisture absorption, in addition to insulating properties. Polytetrafluoroethylene coatings may provide a low friction contact between the textile and the skin, thereby limiting the formation of blisters. Nylon is a durable and abrasion-resistant material with high strength. Finally, polyester is a hydrophobic material that also provides relatively high durability. Accordingly, the materials comprising the yarn may be selected to impart a variety of physical properties to heel section 32 or any other section of upper 30. The physical properties may include, for example, strength, stretch, support, stiffness, recovery, fit, and form.

Instep section 33 extends along the instep from ankle section 31 and provides four-way stretch. Although the knit may be similar to ankle section 31, instep section 33 will generally be formed to have a single layer, rather than the overlapping layers of ankle section 31. The same yarn utilized for ankle section 31 may be utilized for instep section 33. In addition, a plurality of openings 38 may be formed in instep section 33 to enhance the stretch properties of instep section 33. Instep section 33 may be formed by using three feeds of yarns, for example. When switching between the feeds, a tuck stitch is generally utilized. By not forming a tuck stitch in specific locations, openings 37 are formed.

Primary section 34 forms a majority of upper 30 and is positioned to extend along medial and lateral sides of the foot, over the toes, and along the sole of the foot. As with heel section 32, primary section 34 includes a plurality of ribs 37. In general, ribs 37 are oriented to permit upper 30 to stretch around the foot, and to limit longitudinal stretch along the foot. Heel section 32 and primary section 34 may be formed through the same knitting process, but ribs 37 in each of heel section 32 and primary section 34 are oriented in different directions. The rationale for permitting stretch around the foot in primary section 34 is that upper 30 will conform to feet with various width dimensions. The degree of stretch in primary section 34 may be adjusted by utilizing a yarn with greater denier and increasing the course density.

Toe section 35 extends around the portion of upper 30 that corresponds with the ends of the toes, and toe section 35 includes a plurality of ribs 37 that are oriented horizontally. In this orientation, stretch is provided in the horizontal direction. Any of the materials discussed above with respect to heel section 32 may be utilized for primary section 34 and toe section 35.

A narrow-tube circular knitting machine may be utilized to manufacture upper 30. An example of a circular knitting machine that may be utilized to form upper 30 will be discussed in greater detail below. In general, circular knitting machines form a tube-like structure. Upper 30, therefore, also has a tube-like structure with openings at opposite ends of the tube. The ankle opening in ankle section 31 forms a first opening, and an aperture 39 in the lower surface of primary section 34 forms a second opening. Aperture 39 is analogous to the seam that extends over the toes in a conventional sock that is also manufactured on a circular knitting machine. Insole 21, which is positioned within upper 30, may be utilized to cover aperture 39.

Based upon the above discussion, upper 30 has a knit structure with various sections 31–35 that impart different physical properties. Ankle section 31 is formed of a yarn and knit that provides four-way stretch. Heel section 32 is formed of a different yarn and a different knit to provide two-way stretch and durability, for example. Instep section 33 also provides four-way stretch, but includes only a single layer of knit material. Similar considerations are also applicable to primary section 34 and toe section 35. Accordingly, the different sections 31–35 of upper 30 impart physical properties that are specially selected for the each section 31–35. More specifically, the knitting process that produces upper 30 forms a plurality of sections 31–35 that are specifically located, knit in a specific manner, and knit with a specific type of yarn to provide each section 31–35 with different physical properties. The physical properties may include, for example, strength, stretch, support, stiffness, recovery, fit, and form.

In manufacturing upper 30 with a circular knitting machine, various types of yarn and various knit structures are utilized to form the various sections 31–35. As discussed above, upper 30 is manufactured to have the general shape of a tube. The circular knitting machine, therefore, operates to form a first course, which corresponds with an end of the tube. A second course is then knit adjacent to the first course, and the process continues through successive courses until upper 30 is complete.

The manner in which the circular knitting machine changes between different yarn types and knit structures depends upon whether the change occurs between adjacent courses or between adjacent wales. A course is a horizontal row of needle loops. In general, a circular knitting machine may knit a first course with a first yarn and then knit a second course with a second yarn without altering the structure of the knit material. That is, two courses that are formed of two different types of yarn will have a structure that is substantially identical to two courses formed of the same yarn, except for the differences imparted by the different yarns.

Whereas a course is a horizontal row of needle loops, a wale is a vertical column of intermeshed needle loops. A course, therefore, includes a plurality of wales. In forming two wales from the same yarn, a circular knitting machine merely makes successive knits along the course. To form two wales from different yarns, however, a circular knitting machine forms a tuck stitch between the wales of different yarns. That is, a tuck stitch is utilized to seamlessly connect two wales formed of different yarns. In forming upper 30, therefore, tuck stitches are often utilized to seamlessly join the various sections 31–35 between two adjacent wales. An advantage to utilizing the tuck stitches, rather than some other methods of joining the sections, is that the ends of yarns, otherwise referred to as tails, are not exposed, thereby decreasing the possibility of unraveling between the sections.

Referring specifically to upper 30, tuck stitches 11 are utilized between instep section 33 and primary section 34 to join sections 33 and 34 together. No tuck stitches 11 are necessary between ankle section 31 and instep section 33, for example, because ankle section 31 and instep section 33 are joined between courses, rather than wales.

Accordingly, tuck stitches 11 are utilized in any portion of upper 30 to join wales formed of two different yarns.

Figure 3:
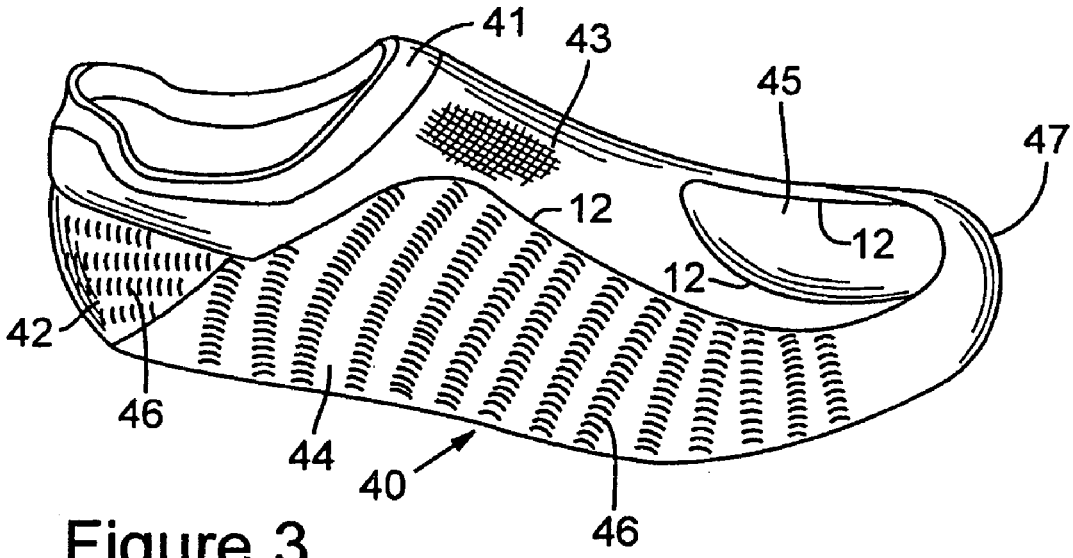
FIG. 3 is a perspective view of another upper in accordance with the present invention.

Upper 30 is intended to provide one example of a suitable upper for footwear 10 or other articles of footwear that include a knit structure for the upper. Other uppers may be formed to have a variety of other configurations. That is, the various sections of other uppers may be positioned, knit from specific yarns, and formed with a specific knit structure to achieve a desired purpose. For example, an upper 40, which is also suitable for footwear 10, is depicted in FIG. 3. Upper 40 includes an ankle section 41, a heel section 42, an instep section 43, a primary section 44, and a metatarsal section 45.

Ankle section 41 is configured to surround the ankle and form an ankle opening that provides access to the interior of upper 40. Heel section 42 is configured to extend around a portion of the heel. Instep section 43 extends along the instep from ankle section 41, and extends around the ankle to thereby separate ankle section 41 from heel section 42. Primary section 44 extends along medial and lateral sides of the foot, over the toes, and along the sole of the foot. Finally, metatarsal section 45 is located within instep section 43 and generally covers a forward portion of the foot. Upper 40 may also include a section that is similar in location and structure to toe section 35 of upper 30.

Upper 40 is formed primarily from multiple yarns that are mechanically manipulated through an interlooping process to produce a unitary structure having various sections 41–45 with different physical properties. The physical properties may include, for example, strength, stretch, support, stiffness, recovery, fit, and form. The various yarns may be selected to include any of the yarns discussed above with respect to upper 30. In addition, tuck stitches 12 are utilized in any portion of upper 40 to seamlessly join wales formed of two different yarns.

Figure 4:
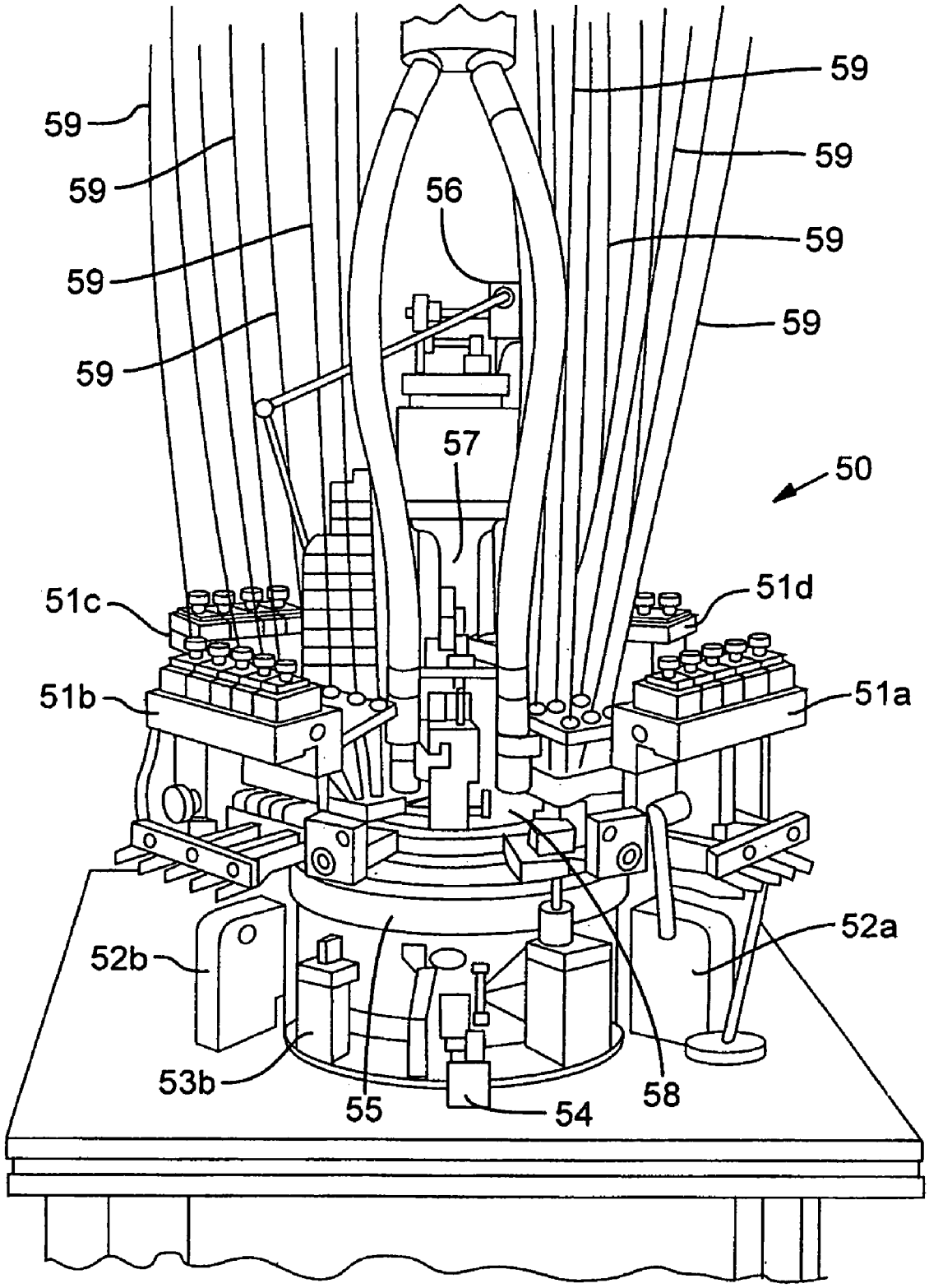
FIG. 4 is a perspective view of a narrow-tube circular knitting machine that may be utilized in manufacturing uppers in accordance with the present invention.

A method of manufacturing upper 40 will now be discussed with reference to an exemplary embodiment of a narrow-tube circular knitting machine 50, which is depicted in FIG. 4. One skilled in the relevant art will appreciate that the concepts disclosed in the following discussion also apply to the manufacture of upper 30 or any other upper in accordance with the present invention. Knitting machine 50 is similar to conventional circular sock knitting machines, which knit in a circular fashion to create tubular structures, such as socks. The conventional circular knitting machines typically form the socks, for example, from two separate feeds of yarn with each feed including up to ten different types of yarns. Using the conventional knitting machine, multiple steps and operations are required to knit the sock. For example, the conventional sock is knit using a continuous forward motion of the knitting machine cylinder to first knit the rib and leg portions of the sock. The cylinder then switches into a fixed reciprocating motion to knit the heel pocket of the sock. The cylinder returns to the continuous forward motion to knit the foot portion of the sock. Finally, the cylinder switches back into the fixed reciprocating motion to knit the toe pocket of the sock.

Unlike conventional two feed circular knitting machines, knitting machine 50 has four feeds of yarn, with each feed containing up to ten different types of yarns in fingers. An example of a suitable, commercially available narrow-tube circular knitting machine that may be utilized as knitting machine 50 is sold by Sangiocomo S.p.A. of Italy under the X-MACHINE trademark. The X-MACHINE has been used to produce argyle-style socks where multiple colored yarns form argyle and other complex patterns.

Knitting machine 50 is depicted in FIG. 4 and includes first, second, third, and fourth feed valve assemblies 51*a*–51*d*, respectively. Each assembly 51*a*–51*d* is associated with a feed finger assembly, a feed center cam, and a forward and reverse stitch cam. Only the first and second feed finger assemblies 52*a* and 52*b*, the second feed cam 53*b*, and the first and second forward and reverse stitch cam 54, however, are depicted in FIG. 4. A 160 needle, 4 inch cylinder assembly 55 is centrally located. Finally an elastic power feeder 56, a dial head assembly 57, and a dial and circular cutter 58 are positioned above cylinder assembly 55. Extending downward from spools are a plurality of yarns 59.

In manufacturing upper 40 with knitting machine 50, a plurality of tuck stitches 12 are utilized to join wales formed of two different yarns. Accordingly, tuck stitches 12 are present between instep section 43 and primary portion 44, for example. Tuck stitches are also utilized between side portions of metatarsal section 45 and instep section 43. No tuck stitches 12 are necessary, however, to join courses formed of different yarns.

Accordingly, no tuck stitches are present between ankle section 41 and instep section 43, for example. Numerous yarn materials of varying diameters, sizes, stretch characteristics and colors, thus, can be used to manufacture upper 40.

Knitting machine 50 has the ability to run in a continuous or in a reciprocating motion, and can select groups or patterns of needles in either the knit, tuck or float position. Utilizing the four yarn feeds of the machine, different yarn types can be used and different patterns and textures can be formed within sections 41–45, and the various sections 41–45 may be linked together by the use of tuck stitches, where necessary to join wales of different yarns. Advantageously, knitting machine 50 knits the different sections 41–45 in a continuous manner so that no additional manufacturing steps are required to sew or otherwise attach adjoining sections 41–45. As a result, there are no seams in the footwear between adjoining sections and the amount of material waste is reduced.

As discussed above, knitting machine 50 may be utilized to impart different physical properties to sections 41–45 through the use of different yarns and knits. For example, instep section 43 can be knit with a stretch yarn, such as a yarn that incorporated LYCRA, to provide adjustability in this portion of upper 40. By controlling the type of yarn used to fabricate instep section 43, materials offering greater elasticity may be fabricated into this region to achieve the desired stretch characteristics. Similarly, in primary section 44, where abrasion resistance may be considered important, knitting machine 50 may be utilized to provide a yarn with suitable abrasion resistance characteristics, such as nylon or polyester. Other possible physical properties may be fabricated into upper 40, including stretch resistance, softer texture, and improved breathability, for example. In addition, the color of the yarns may be varied to provide a desired aesthetic.

In manufacturing upper 40, knitting machine 50 initially produces the sculptured ankle section 41. By continuing to knit various courses, the portion of instep section 43 that is adjacent to ankle section 41 is knitted. Both ankle section 41 and instep section 43 may be formed from a yarn with high stretchability. Furthermore, ankle section 41 may be formed to have two overlapping layers for greater durability around the ankle opening.

Heel section 42 is then knit with a different yarn and texture by utilizing additional needles in a reciprocating action to create a rounded heel pocket or turn in the tube structure of upper 40. A non-stretch yarn may be utilized in heel section 42. This process uses about 75 percent of the cylinder needles as opposed to 50 percent in conventional knitting to create a defined heel pocket. Like heel section 32 of upper 30, heel section 42 includes a plurality of ribs 46 oriented horizontally to produce two-way stretch in the horizontal direction.

After forming heel section 32, knitting machine 50 may form portions of primary section 44 and instep section 43. Primary section 44 includes a plurality of ribs 47 that are oriented to extend laterally across upper 40, and primary section 44 may be formed of a durable yarn, such as polyester or nylon, for example. In manufacturing this portion of upper 40, knitting machine 50 continuously forms courses around upper 40. Accordingly, each course includes a transition between the yarn utilized to form primary section 44 and the different yarn utilized to form instep section 43. Because the transition is between adjacent wales, a tuck stitch 12 joins primary section 44 and instep section 43. Each course also includes a transition between instep section 43 and primary section 44, in which another tuck stitch 12 is utilized.

As knitting machine 50 continues to manufacture upper 40, additional courses are added and primary section 44 and instep section 43 continue to lengthen, and metatarsal section 45 is formed. Tuck stitches 12 are also utilized in the transition from instep section 43 to metatarsal section 45, and tuck stitches 12 are again utilized in the transition from metatarsal section 45 to instep section 43. The tuck stitches 12 utilized in the transitions between instep section 43 and metatarsal section 45 are in addition to the tuck stitches between primary section 44 and instep section 43. Accordingly, each course extending through metatarsal section 45 includes four tuck stitches 12 to join adjacent wales formed of different yarns.

A toe area 46 of upper 40 is formed in a manner that is similar to a conventional toe portion of a sock, with the exception of the texture of the fabric and the utilization of more needles action to create a defined toe pocket or turn in the tube fabric. Also, a 180-degree turn of the toe fabric is formed prior to the final press off, or release of the yarns, to position the final course on the bottom of upper 40, which is later covered by a sole structure. Upper 40 is finished at the bottom without a seam. This is accomplished by finishing the knitting process with a yarn that contains water-soluble fibers. The water-soluble fibers permit the fabric to shrink in the dyeing process and provides a finished edge, thereby eliminating the conventional seaming step and allowing upper 40 to lie flat on the outsole without the presence of a ridge, which is conventionally created by a seam.

The general shape of upper 30 and upper 40 may be selected to be the general shape of a foot. Accordingly, a last may be placed within upper 40 and any additional parts, such as a midsole and an outsole may be connected to upper 40 in a form-fitting relation by adhesion, molding, sewing or any other conventional method of attachment. Similarly, a last may be placed within upper 30 and sole structure 20 may be subsequently attached.

It should also be understood that the method of the present invention may use numerous types of recyclable materials. For example, the yarns utilized in uppers 30 and 40 may include recyclable fibers or filaments. In addition, cotton or wool yarns may be utilized to enhance biodegradability of the footwear.

In accordance with the above discussion, uppers 30 and 40 are lightweight footwear elements that include various sections of different physical properties that are seamlessly joined with tuck stitches 11 and 12, respectively. The sections may exhibit two-directional stretch, four dimensional stretch, no stretch, enhanced durability, high moisture absorption and breathability, and enhanced abrasion-resistance, for example. It should be understood by those skilled in the relevant art that these sections are simply representative of the possible types of sections that may be fabricated into upper 30, upper 40, or any other upper produced by the method of the present invention.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article for receiving a foot of a wearer, the article comprising a plurality of sections formed of knit materials, the plurality of sections including a first section and a second section, the first section including a first yarn with a first physical property, the first yarn being substantially absent from the second section, and the second section including a second yarn with a second physical property, the second yarn being substantially absent from the first section, the first physical property being different than the second physical property, and the first and second sections being connected by tuck stitches, the hick stitches joining the first section and the second section in a seamless manner between adjacent wales.

2. The article of claim 1, wherein a knit of at least one of the first section and the second section defines a plurality of apertures.

3. The article of claim 1 wherein the plurality of sections form a sock.

4. The article of claim 1, wherein a stretchability of the first yarn is greater than a stretchability of the second yarn.

5. The article of claim 1, wherein an abrasion-resistance of the first yarn is greater than an abrasion-resistance of the second yarn.

6. The article of claim 1, wherein a knit of at least one of the first section and the second section is ribbed.

7. The article of claim 1, wherein a material of the first yarn is different than a material of the second yarn.

8. An article for receiving a foot of a wearer, the article comprising a plurality of sections formed of knit materials, the sections including:

an ankle section;

an instep section positioned forward of the ankle section;

a heel section positioned below the ankle section; and a primary section that forms a lower portion and side portions of an upper, at least two of the sections being formed of different yarns with different physical properties, each of the yarns in a first of the at least two of the sections being absent from a second of the at least two the sections, and the at least two of the sections being joined by tuck stitches in a seamless manner, the tuck stitches joining the at least two sections between adjacent wales.

9. The article of claim 8, wherein the different physical properties are stretchabilities of the yarns.

10. The article of claim 8, wherein the different physical properties are abrasion-resistances of the yarns.

11. The article of claim 8, wherein the plurality of sections form a sock.

12. The article of claim 8, wherein a knit of at least one of the sections is ribbed.

13. The article of claim 8, wherein the different yarns are formed from different materials.

14. An article for receiving a foot of a wearer, the article comprising a plurality of sections formed of knit materials, the plurality of sections including:

a first section substantially formed a first yarn with a first physical property, the first yarn being knit such that the first section exhibits a first type of stitch; and a second section substantially formed a second yarn with a second physical property, the second yarn being knit such that the second section exhibits a second type of stitch, wherein the first physical property is different than the second physical property, the first type of stitch is different than the second type of stitch, the first yarn is substantially absent from the second section, the second yarn is substantially absent from the first section and the first section and the second section are connected by tuck stitches, the tuck stitches joining the first section and the second section in a seamless manner between adjacent wales.

15. The article of claim 14, wherein the first section and the second section are formed of yarns incorporating different materials.

16. The article of 14, wherein the different physical properties are stretchabilities of the yarns.

17. The article of claim 14, wherein the different physical properties are abrasion-resistances of the yarns.

18. The article of claim 14, wherein the second section and a third section that is separate from the second section are joined by tuck stitches, the tuck stitches joining the second section and the third section between adjacent wales.

19. The article of claim 14, wherein the plurality of sections form a sock.

20. An article for receiving a foot of a wearer, the article comprising a plurality of sections formed of knit materials, the plurality of sections including a first section and a second section, the first section including a first yarn with a first physical property, the first yarn being substantially absent from the second section, and the second section including a second yarn with a second physical property, a material of the first yarn being different than a material of the second yarn, and the second yarn being substantially absent from the first section, the first physical property being different than the second physical property, and the first and second sections being connected by tuck stitches, the tuck stitches joining the first section and the second section in a seamless manner.

21. The article of claim 20, wherein a knit of at least one of the first section and the second section defines a plurality of apertures.

22. The article of claim 20 wherein the plurality of sections form a sock.

23. The article of claim 20, wherein a stretchability of the first yarn is greater than a stretchability of the second yarn.

24. The article of claim 20, wherein an abrasion-resistance of the first yarn is greater than an abrasion-resistance of the second yarn.

25. The article of claim 20, wherein a knit of at least one of the first section and the second section is ribbed.

* * * * *

UNITED STATES PATENT AND TRADEMARK OFFICE

CERTIFICATE OF CORRECTION

PATENT NO. : 7,131,296 B2
APPLICATION NO. : 11/334731
DATED : November 7, 2006
INVENTOR(S) : Bhupesh Dua and Edward Nathaniel Thomas It is certified that error appears in the above-identified patent and that said Letters Patent is hereby corrected as shown below:

Column 10, line 55, change “hick” to -- tuck --.

Column 11, line 44, change “section” (first occurrence) to -- section, --.

Signed and Sealed this

Ninth Day of January, 2007

JON W. DUDAS
*Director of the United States Patent and Trademark Office*